United States Patent [19]

Vecchiarelli

[11] 4,032,008

[45] June 28, 1977

[54] TOOL HOLDER GUIDE INDICIA FOR TAP AND DRILL SETS

[76] Inventor: Richard N. Vecchiarelli, 64 Prospect St., Ludlow, Mass. 01056

[22] Filed: June 7, 1976

[21] Appl. No.: 693,735

[52] U.S. Cl. ..... 206/379; 40/312; 206/459

[51] Int. Cl.[2] ..... B65D 85/24

[58] Field of Search ..... 40/312; 206/229–230, 206/234, 372–373, 379, 443, 459, 526; 211/60 T

[56] References Cited

UNITED STATES PATENTS

| | | | |
|---|---|---|---|
| 2,564,601 | 8/1951 | Huot | 206/379 |
| 2,568,089 | 9/1951 | Pendleton | 206/379 X |
| 2,736,426 | 2/1956 | Hamilton | 206/379 |

FOREIGN PATENTS OR APPLICATIONS

| | | | |
|---|---|---|---|
| 485,363 | 8/1952 | Canada | 206/379 |

*Primary Examiner*—Steven E. Lipman
*Attorney, Agent, or Firm*—Chapin, Neal and Dempsey

[57] ABSTRACT

Tool holder having a row of spaced tool supporting sockets each adapted to receive and support in an upright position therein the shank portion of one of a series of drill bits of increasing diametrical size from one end to the other end of the row. The tool holder includes a second row of tool supporting sockets spaced from the first row and adapted to receive and support in an upright position therein the shank portion of one of a series of thread cutting taps of increasing diametrical size from one end to the other end of said second row. Indicia are provided which extend from each tap socket toward a predetermined correlative pair of spaced drill sockets. Each such pair of drill sockets is adapted to retain therein the proper tap drill and clearance drill for each corresponding tap.

4 Claims, 3 Drawing Figures

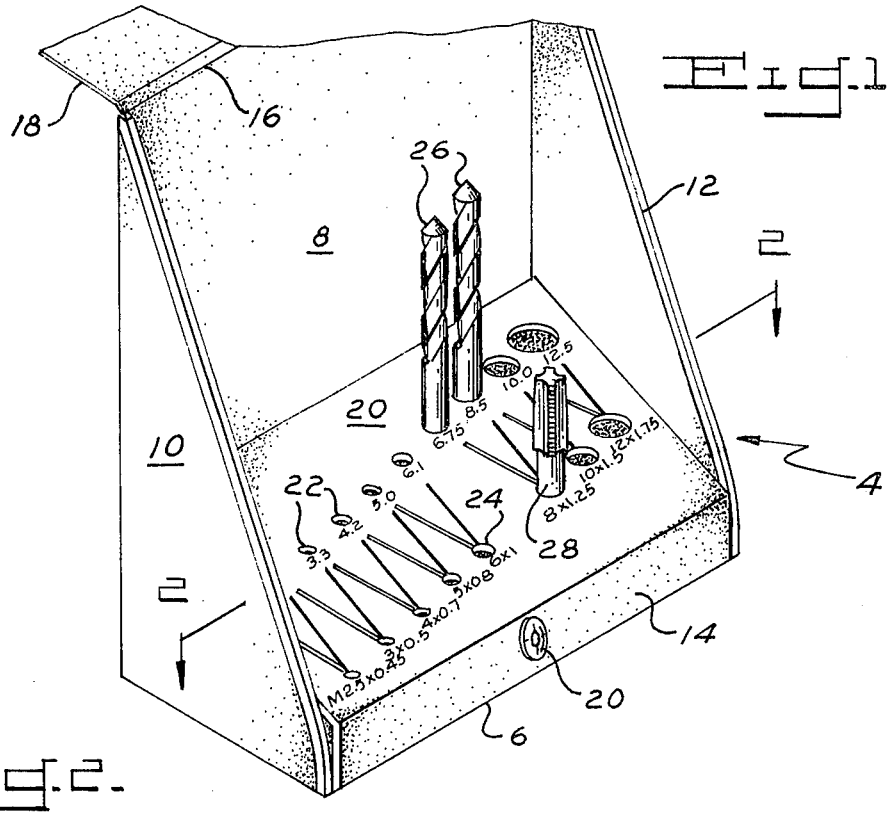
Fig. 1.
Fig. 2.
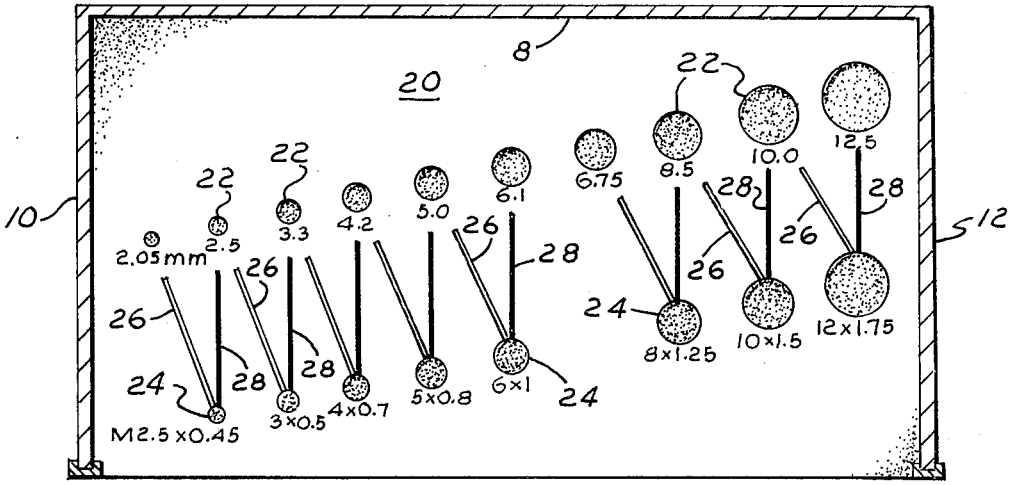
Fig. 3.
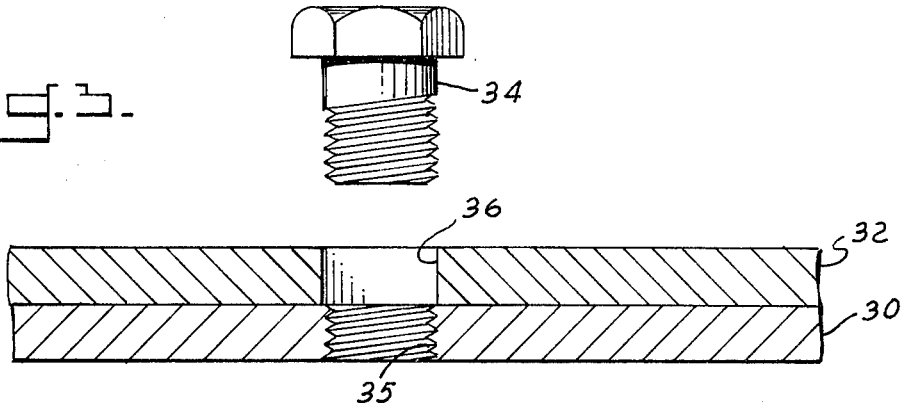

TOOL HOLDER GUIDE INDICIA FOR TAP AND DRILL SETS

BACKGROUND

In preparing tapped holes for receiving screw threaded fasteners, it is well recognized that for each particular size screw thread, a drilled hole must be first provided in the material which is to be tapped. Taps permit little variation in operating conditions as the rate of metal removed per rpm is governed by the effective chamfer length, the tap speed and minor diameter of the product. If the tap drill is not the proper size, thread height may be inadequate, or the tapping torque required may increase sharply and result in unsatisfactory tapped holes or even tap breakage. It is, therefore, important to select the optimum size tap drill for use with each tap. After a tap is used to cut threads in the previously drilled hole, it also may be necessary to drill a clearance hole through a second material to enable a threaded fastener to be inserted through the clearance hole into engagement with the threaded hole. Thus for each tap size, it is frequently necessary to have two different drill sizes available, i.e., the tap drill and the clearance drill for each tap size. The general practice has been to provide separate tap and drill sets with the drill sets having twice the number of drills as the corresponding tap set. Moreover, such drill and tap sets provide no convenient means for correlating the proper tap drill and clearance drill for each tap. The user will generally make reference to various reference tables for guidance in the selection of the proper drill sizes to use with each tap size.

It is the principal object of this invention to provide a unitary tool holder combining a series of taps and drills in which indicia indicate the proper tap drill and clearance drill for use with each tap.

It is another object of this invention to provide a tool holder of the above type containing the tap drills of a given size which serve both as the tap drill for one tap and as the clearance drill for the next smaller tap in the successive series.

A further object of this invention is to provide a tap and drill set in a holder of the above type in which the number of drills is only two more than the number of taps.

The above and other objects and advantages of this invention will be more readily apparent from the following description and with reference to the accompanying drawing, in which:

FIG. 1 is a perspective view showing a tool holder embodying this invention;

FIG. 2 is a sectional view taken along line 2-2 of FIG. 1; and

FIG. 3 is a cross sectional elevational view illustrating the advantageous use of the tools from the tool holder embodying this invention.

Referring in detail to the drawing, a unitary tool case or holder of the type embodying this invention is shown generally at 4. The tool holder preferably take the form of a combination storage and display case and workbench holder having a generally flat, rectangular base portion 6, an upstanding rear wall 8 and generally triangular or tapered side walls 10 and 12. The inclined edges of the side walls extend from the front wall portion 14 of the case upwardly and rearwardly terminating at flexible hinge line 16 from which closure flap or cover panel 18 extends. The cover may be swung to and from a case closing condition wherein the flap 18 is in contact with the inclined edges of walls 10 and 12. The wall portion 14 of the case is provided with one element 20 of a snap fastener combination and the mating post element (not shown) is carried adjacent the outer edge of the closure or cover 18. When the cover 18 is closed, a generally wedge shaped case results which is compact for shipping, handling and storage. The cases may be stacked in minimum space by juxtaposing the apex of one case atop the base of the underlying case and vice versa.

From its front wall 14, the tool holder includes a base panel 20 which extends rearwardly and is inclined upwardly. Base 20 is provided with a plurality of tool holding sockets or bores 22 and 24. The sockets 22 are arranged along one row which extends transversely of the base 20. The sockets 22 are of increasing diametrical size from adjacent the wall 10 toward the opposite wall 12 of the holder. The sockets 24 are arranged in a second row which is spaced forwardly of and parallel to the first row. The sockets 24 are also of increasing size starting from adjacent the wall 10 toward the wall 12. Each of the sockets 22 is adapted to receive the shank portion of one particular size drill bit, as shown at 26 in FIG. 1, whereby the drill bits will increase incrementally in diametric size from one end of the row to the other. Adjacent each drill receiving socket, the base 20 is imprinted with the size of the drill to be held therein, ranging in the embodiment shown from 2.05 mm to 12.5 mm. In the second row of sockets 24, each socket is adapted to receive the shank end of a tap, such as shown at 28. The diameters of sockets 22 and 24 are such as to fit closely the shank portion of the tool to be fitted therein and are of sufficient depth so that the taps 28 and drills 26 are supported in an upright position within the holder for convenient display of the holes. Adjacent each socket 24, the base 20 is imprinted with the size of the tap held therein. In the embodiment shown, the smallest tap is marked "2.5 × 0.45" and at the opposite end of this row, the largest socket is imprinted "12 × 1.75", which indicates a 12 mm tap for cutting a 1.75 mm thread pitch. The row formed by the plurality of laterally spaced sockets 22 and the row formed by the plurality of laterally spaced sockets 24 are generally parallel with eight tap sockets 24 and ten drill sockets 22. The tap sockets 24 include a first series numbered consecutively "2.5 – 3 – 4 – 5 – 6". A second series of larger taps is provided with "8 – 10 – 12 – ". There being no generally available 7 mm tap, as provided for by international tap standards, no socket is provided therefor. For the first smaller set of five taps, i.e., 2.5 – 6, there are six corresponding drill bit sockets 2.05 – 6.1. For the second set of three taps, i.e., 8 – 12 mm, there are four drill sockets, i.e., 6.75 – 12.5 mm. It will thus be seen that for each series of commercially available consecutive size metric taps, the tool holder includes a number of drill sockets equal to one more than the number of such tap sockets.

From each tap receiving socket 24 a pair of contrasting indicia 26 and 28 extend in diverging relationship to two adjacent drill sockets 22. In the embodiment shown, the indicia are imprinted on the base 20 in the form of spaced lines 26 and solid or dark bars 28. Any other suitable contrasting indicia may be used for quick visual reference in guiding the eye of the user to the proper tool to be used for a given task. Similarly, except for the outer end drill sockets 22, i.e., those marked 2.05, 6.1, 6.75 and 12.5, each of the drill sockets is located at the convergence of the two indicia 26 and 28. Each of the drills in these sockets serve two functions, both as a clearance drill for one tap and a tap drill for the next successive tap. This arrangement results in a minimum number of drills for each tap set.

The use of indicia 26 and 28, will be understood by reference to the first tap socket marked "2.5 × 0.45". From this socket line 26 extends toward drill socket marked "2.05 mm" and the solid bar 28 extends toward the drill socket marked "2.5". This means that the 2.05 mm tap drill should be used with the 2.5 mm tap and that the clearance drill to be used is 2.5 mm. Further, by way of example, the 6 mm tap socket has an open line 26 which leads toward the "5.0"mm drill socket and solid bar 28 leads toward the 6.1 mm socket. This arrangement correlates the two correct drills to be used in conjunction with the 6 mm tap. Thus, for example, if one wishes to fasten together a pair of metal plates, such as indicated at 30 and 32 in FIG. 3, using a 6 mm threaded fastener, he would simply glance at the 6 mm tap socket and follow indicia line 26 toward drill socket "5.0". This drill bit would then be used to drill a 5 mm hole in plate 30. Having accomplished this task, the operator would then tap this drilled hole using the tap marked "6 × 1", thereby providing an internally threaded hole 35. The operator would then refer back to the tool holder base 20 and follow solid bar 28 to the drill socket marked "6.1" which is the proper drill size to provide clearance hole 36 in plate 32. The fastener 34 may thus be inserted through clearance hole 36 and screwed into thread base 35 to fasten the two plates together. In using this combination tool holder and tap and drill set, only a minimum of instruction is required. For example, by simply imprinting instructions on the back panel 8, or other convenient location, the user may be advised that for each tap size, the open line indicia shows the proper tap drill to be used and the dark bar designates the proper clearance drill to be used with such tap.

While in the illustrated embodiment, the holder is provided for use with a metric set of taps and drills, the concept may also be employed with tools sized in the English or Witworth Standard of measurement.

Having thus disclosed my invention, what is claimed is:

1. Tool holder for a plurality of taps and a plurality of drills disposed therein comprising means for holding said taps in a predetermined succession according to the diametrical size of said taps, means spaced from the succession of taps for holding said drills in a predetermined succession related to the diameter thereof, each of said tap and drill holding means being adapted to receive and hold a drill and tap of a given size, and indicia which lead from each tap holding means toward a pair of adjacent drill holding means adapted to hold drills of different diametrical size, one of said pair of drills being the tap drill for the tap from which one of said indicia leads and the other of said pair being the clearance drill toward which the other of said indicia leads, said indicia including adjacent pairs thereof which extend toward each of a plurality of said drill holding means in converging relation, each drill holding means toward which said indicia extend in converging relation being adapted to hold one drill of the proper diametrical size to serve as both the clearance drill for one of said taps and the tap drill for the next successive size tap whereby a plurality of said drills are dual functional for use with successive size taps.

2. Tool holder for a plurality of taps and a plurality of drills disposed therein as set forth in Claim 1 in which said indicia extending from each tap holding means toward a pair of successive drill holding means are of contrasting appearance.

3. Tool holder for a plurality of taps and a plurality of drills disposed therein as set forth in claim 2 in which said holding means comprise spaced sockets adapted to receive therein the shank portions of said drills and taps, said sockets being of increasing diametrical size arranged in first and second spaced rows, the first row containing taps of sequentially increasing diametrical size and the second row containing drills of sequentially increasing diametrical size.

4. Tool holder for a plurality of taps and a plurality of drills disposed therein as set forth in claim 3 in which said sockets extend into a base panel of the tool holder and in which said indicia are imprinted on the base panel, and adjacent pairs of said indicia extending in diverging relationship from each tap socket toward a predetermined spaced pair of drill sockets.

* * * * *